US006991005B2

(12) United States Patent
Fedeli

(10) Patent No.: US 6,991,005 B2
(45) Date of Patent: Jan. 31, 2006

(54) PIERCING APPARATUS FOR PIERCING A SMALL COMPRESSED GAS BOTTLE TO QUICKLY INFLATE A SACK AND TOOL FOR RELOADING THE PIERCING APPARATUS

(76) Inventor: Benedetto Fedeli, 7 Av. Saint Roman, Monaco (MC)

( * ) Notice: Subject to any disclaimer, the term of this patent is extended or adjusted under 35 U.S.C. 154(b) by 0 days.

(21) Appl. No.: 10/962,543

(22) Filed: Oct. 13, 2004

(65) Prior Publication Data

US 2005/0081947 A1 Apr. 21, 2005

(30) Foreign Application Priority Data

Oct. 15, 2003 (IT) ..... RM2003A0473

(51) Int. Cl.
*B65B 1/04* (2006.01)

(52) U.S. Cl. ..... 141/114; 141/19; 222/5; 222/54

(58) Field of Classification Search ..... 141/19, 141/114, 329, 330, 313; 222/5, 54; 441/92–95, 441/41

See application file for complete search history.

(56) References Cited

U.S. PATENT DOCUMENTS 5,601,124 A * 2/1997 Weinheimer et al. ..... 141/19
6,705,488 B2 * 3/2004 Mackal et al. ..... 222/5

* cited by examiner

*Primary Examiner*—Steven O. Douglas
(74) *Attorney, Agent, or Firm*—Young & Thompson

(57) ABSTRACT

A piercing apparatus for piercing a small compressed gas bottle to quickly inflate an expandable sack (1) comprises a small gas bottle (6), a housing (20) carrying in an inner chamber (21) thereof a piercing element (7) having a bit (72) provided with an axial passageway (73) communicating with the sack (1), and a release mechanism (8), being charged by a counteracting spring (89) to push the piercing element (7) against the small bottle (6). The release mechanism comprises a release element, being connected to a flexible transmission (30) of control means (3), as a protuberance (87), and the piercing element (7) is fixed on a front end of a collet chock (70), which is provided with fingers (88) to grip the protuberance (87). The collet chock (70) is slidable between a gripping condition and a releasing condition of the protuberance (87) upon the operation of control means.

6 Claims, 4 Drawing Sheets

PIERCING APPARATUS FOR PIERCING A SMALL COMPRESSED GAS BOTTLE TO QUICKLY INFLATE A SACK AND TOOL FOR RELOADING THE PIERCING APPARATUS

This invention relates to a piercing apparatus for piercing a small compressed gas bottle to quickly inflate a sack. Further the invention concerns a tool for reloading the piercing apparatus.

The same applicant is also the owner of the Italian patent No. 1.307.293 entitled "An ejection device to expel objects from the inside of a bag in the event of a bag-snatching". Such a device comprises an expandable sack which is arranged on the bottom of a bag below its lining. The expandable sack is connected to a small compressed gas bottle having a pierceable mouth so that the expandable sack is able to be inflated from a wait condition wherein it is empty to an operated state wherein the expandable sack is inflated to a volume greater than the internal volume of the bag. A housing, which is connected to the small compressed gas bottle and to the expandable sack, internally carries a piercing element provided with an axial passageway communicating with the expandable sack through a hollow cylindrical body thereof which is movable under a pre-charged spring. A release mechanism of the pre-charged spring to push the piercing element is provided. The release mechanism has an ogival release member that is in engagement with the piercing element through small balls. A control member of the release mechanism comprises a Bowden cable transmission, that is removably retained by a thin plate in the one of its ends near its connection to the ogival release member, and in the other one of its ends a junction member to a portion of the bag designed to be held permanently by who wears the bag, such as a handle or a shoulder-strap. Thus, a snatch being transmitted to the handle or to the shoulder-strap through the Bowden cable transmission, operates the release mechanism and causes the expandable sack to be inflated until the lining is completely overturned outside and a complete ejection of the contents from the bag occurs.

The above mentioned ejection device, even if it fully reaches, with respect to the self-emptying effect, the goals of the Italian patent No. 1.307.293, has some drawbacks.

A first drawback of said patent is that the thin plate retaining the cable transmission of the control member, as the thin plate is easily deformable, is not a means adapted to prevent reliably an undesirable operation of the ejection of the contents in a bag.

A second drawback of the ejection device according to said patent is that a resetting of its release mechanism is troublesome to be performed and causes waste of time.

A third drawback is that in the known ejection device said resetting must be performed by a skilled worker who can use suitable tools.

Therefore, the object of the present invention is to overcome the above mentioned drawbacks.

Particularly, an object of the present invention is to provide a reliable operation of the ejection of the contents in a bag in which such a safety device against the bag-snatching is installed.

Another object of the invention is to allow a quick and reliable resetting of the release mechanism that is used in such an ejection device.

Yet another object of the invention is that there is no need of a skilled worker to reset of the release mechanism that is used in such an ejection device.

A further object of the present invention is to provide a release mechanism that causes a small compressed gas bottle, that is used in different applications from an ejection device of a self-emptying bag, to be pierced.

Therefore, according to this invention there is provided a piercing apparatus for piercing a small compressed gas bottle to quickly inflate a sack, comprising:

an expandable sack being arranged on a base of a container, a compressed gas feeder located below the expandable sack, including:

- a small compressed gas bottle having a pierceable mouth and an externally threaded neck,
- a housing being connected to the small compressed gas bottle and to the expandable sack, and in an inner chamber of the housing a piercing element having a bit provided with an axial passageway communicating with said expandable sack,
- a release mechanism, being charged by a counteracting spring to push the piercing element against the small compressed gas bottle, comprising a release element being connected to a flexible transmission of control means;

characterized in that:

- said release element is a protuberance and is slidably mounted in said inner chamber of the elongated housing by the operation of the flexible transmission against the counteracting spring; and
- said piercing element is fixed on a front end of a collet chock, which, as such, is provided, in its rear end, with fingers to grip said protuberance of the release element; said collet chock being slidable between a gripping condition and a releasing condition of said shaped protuberance upon the operation of control means.

Further the invention concerns a tool for reloading the piercing apparatus.

Now the invention will be described with reference to its preferred embodiment, although it should be appreciated that modifications can be brought without departing from the scope of the invention, with connection to the enclosed drawing, wherein.

Figure 1:
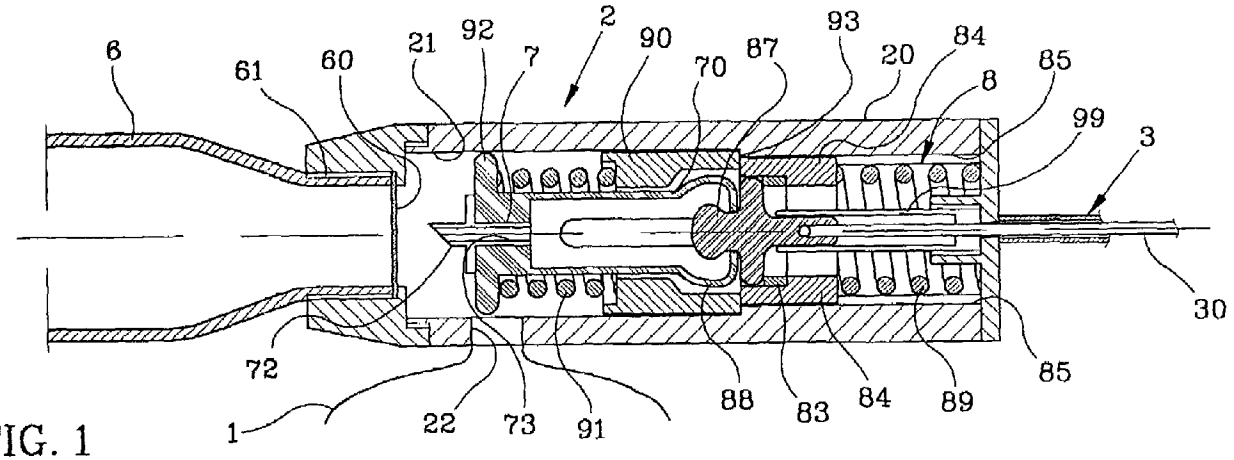
FIG. 1 is a fragmentary longitudinal section view of a piercing apparatus to pierce a compressed gas bottle for quickly inflating a sack according to the present invention, in a loaded condition, before piercing the bottle.
Figure 2:
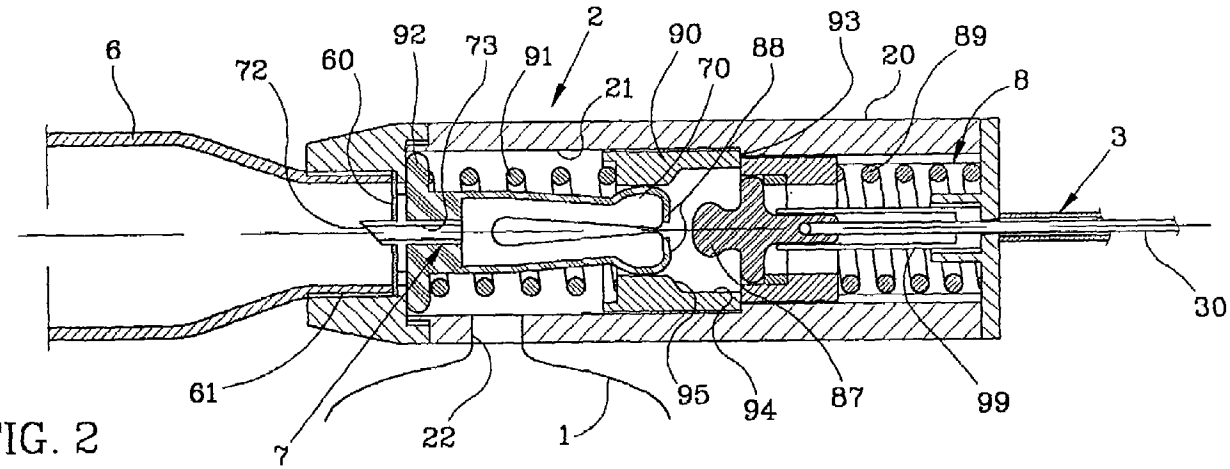
FIG. 2 is a fragmentary longitudinal section view of the piercing apparatus in FIG. 1, in a condition after piercing the bottle.
Figure 3:
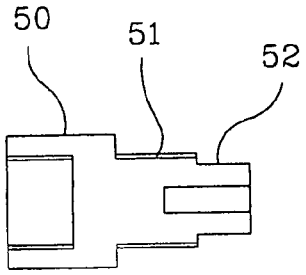
FIG. 3 is a longitudinal section view of a first embodiment of a reloading tool for reloading the apparatus in FIG. 1, after the operation of the release mechanism.

Referring to the drawing, a piercing apparatus according to the invention is shown as a whole in FIGS. 1 and 2 in a wait condition and in an operated state, respectively.

Figure 7:
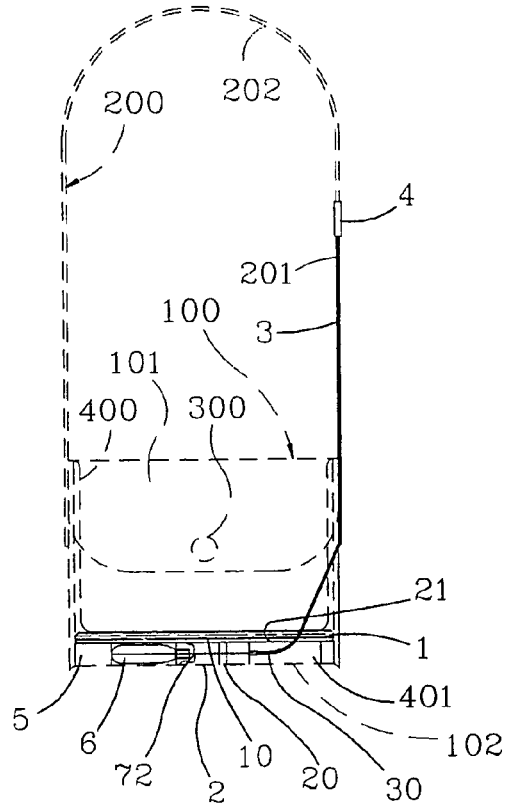
FIG. 7 is a diagrammatic, partially sectioned, front view of the piercing apparatus according to the invention in a wait condition, the apparatus being applied to a closed bag having a shoulder-strap depicted by a dotted line.
Figure 8:
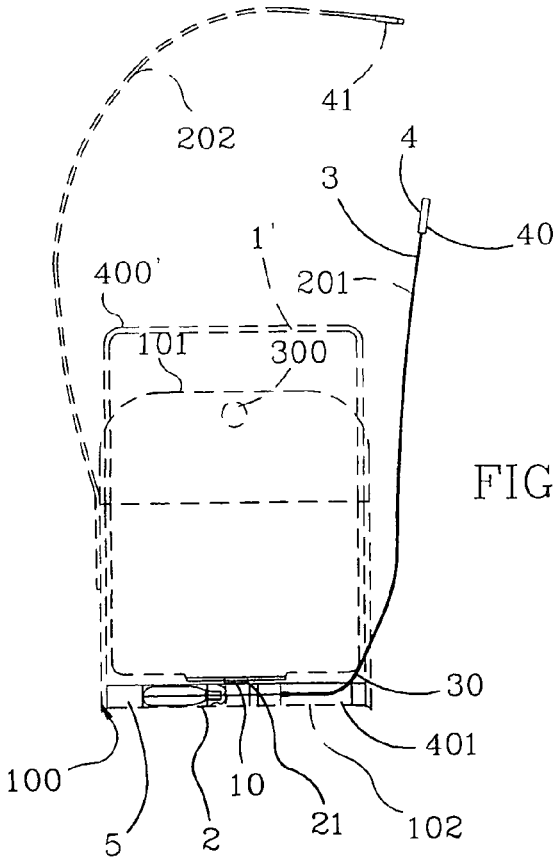
FIG. 8 is a diagrammatic, partially sectioned, front view of the piercing apparatus in FIG. 7 in a operated state, with the bag being consequently opened.

By way of example, such a piercing apparatus can be employed in a self-emptying bag 100, which is depicted by dotted lines in a closed condition (FIG. 7) and in a following consequently opened condition (FIG. 8). By way of example, the bag 100 is endowed with a shoulder-strap 200. The bag 100 is provided with a folding cover 101. Further, with respect to closure means of the folding cover 101, that is diagrammatically shown in 300, it can be of any suitable kind, such as press-stud, Velcro (trade name) or the like, provided that it is yielding under the action of an ejection device, using the piercing apparatus according to the invention, in order to allow the bag to be opened and its contents to fall down.

Conveniently the bag 100 is lined inside by a lining 400 shaped as a pocket that is preferably held, although this is not shown in the drawing, in its upper hem by the edge of the bag in a removable way, e.g. by means of a zip or so called Velcro. Thus, by opening the zip or moving away the edges of Velcro from each other, a hand of a person may enter easily a space 401 between the bottom of the lining 400 and the base 102 of the bag 100.

The bottle piercing apparatus according to the invention is located in the space 401.

The airtight expandable sack 1, as diagrammatically depicted in its collapsed state in FIG. 7, is arranged in a collected way, e.g. folded, under the lining 400. In this inflated state (FIG. 8) the expandable sack 1' takes on the form of a prismatic body, so to be able to keep the lining 400 overturned in 400' as shown in the same figures.

At the bottom the expandable sack 1 is hermetically connected through connection duct 10 to an elongated housing 20 of a compressed gas feeder 2. The elongated housing 20 can be made of a suitable plastic material.

The compressed gas feeder 2 is located below the expandable sack 1, being preferably arranged between restraint panels 5 e.g. of a suitable foamy plastic material, in order to prevent the compressed gas 2 from wandering troublesomely on the base 102 of the bag.

As shown in FIG. 1, which is a longitudinal section view of the compressed gas feeder 2, the generally cylindrical, elongated housing 20 thereof, whose inner chamber 21 is in communication with the expandable sack 1, frontally carries a small bottle 6 of compressed air or other gas and, in a sequence from an end to the other end thereof, a spring-charged piercing element 7 and a release mechanism 8.

The small gas bottle 6, having a pierceable sealed mouth 60, is screwed to the elongated housing 20 by means of its externally threaded neck 61. The small gas bottle has such a capacity that the expandable sack 1, after being inflated instantaneously, is able with its expansion to exert a sufficient force to expel objects contained inside the bag 100 between the lining 400 and the bag cover 101 upon the opening of the closure means and the overturning of the cover.

The gas bottle 6 is closed in its mouth 60 by a septum that is easily pierceable by the piercing element 7 provided with a piercing bit 72. The piercing bit 72, preferably as a mouthpiece of a flute, is shaped so that the cut portion of septum remains in part laterally attached to the septum, without obstructing the emission of gas. In addition, the piercing bit 72 has an axial passageway 73.

The release mechanism 8, which pushes the piercing element 7 against the gas bottle 6, comprises a release member being connected to a flexible transmission 30 of control means 3, e.g. the control means of a self-emptying bag in FIGS. 7 and 8.

According to the present invention, such a release member is a protuberance 87, that is slidable in the inner chamber 21 of the elongated housing 20 by the operation of the flexible transmission 30 against a counteracting spring 89. Preferably, the protuberance 87 is rigidly connected to a cylindrical element 83 that is provided with at least a pair of opposed tooth 84. These tooth 84 are designed to slide on grooves 85 that are provided in the inner chamber 21 of the elongated housing 20.

The piercing element 7 is fixed to one end of a collet chuck 70, which, at the other end, is provided with fingers 88 to grip the protuberance 87 of the release mechanism 8. The collet chuck 70 is very similar to that one of a propelling pencil and can be made of plastic material.

The collet chuck 70, being movable between a gripping condition (FIG. 1) and a releasing condition of the protuberance 87 (FIG. 2), is slidable coaxially with respect to an external cam profile 90 surrounding at least the fingers 88 under the action of a spiral spring 91. The spiral spring 91 is abutted between a flange 92 of the front end of the collet chuck 70 and the external cam profile 90. The external cam profile 90, that is in abutment against an internal circumferential projection 93 of the inner chamber 21 of the elongated housing 20, has an internal space 94, that is preferably cylindrical, with a consecutive frusto-conical portion 95. Then, such an internal space is adapted to receive and retain the fingers 88 of the collet chuck 70 in engagement with the protuberance 87 against the slide of the same collet chuck 70.

In order to assemble the parts of the piercing apparatus inside the inner chamber 21 of the elongated housing 20, a portion of the latter near the connection with the gas bottle 6 is screwed to the remaining portion of the elongated housing 20.

The operation of the piercing apparatus according to the invention is as follows.

By manually acting on the control means 3, which is generally a Bowden cable, its flexible transmission 30 being connected to the protuberance 87, causes the protuberance 87 to slide, by virtue of its tooth 84 engaging the grooves 85 of the inner chamber 21 of the elongated housing 20 against the action of the counteracting spring 89. By the spring 89 the protuberance 87 loses the engagement with the fingers 88 of the collet chuck 70. The fingers, for example four in number, being retained no longer by the protuberance 87 against the cylindrical-frustoconical space 94–95 of the cam profile 90, are able to pass through the cylindrical portion 94 of said space 94–95. The collet chuck 70, that is pushed by the spring 91 in abutment between the flange 92 of the same collet chuck 70 and the cam profile 90, is obliged to travel suddenly toward the front end of the elongated housing 20, where the small gas bottle 6 is screwed. The piercing element 7, having a passageway 73 inside, pierces the sealed mouth 60 of the small bottle and causes the compressed gas therein contained to exit, to pass through the passage 22 into the expandable sack 1. The expandable sack 1 is inflated immediately.

In order to prevent the compressed gas from coming out through the rear portion of the housing 20, a seal gasket 99, being situated around the connection with the flexible transmission 30 of the release element, is provided.

Figure 4:
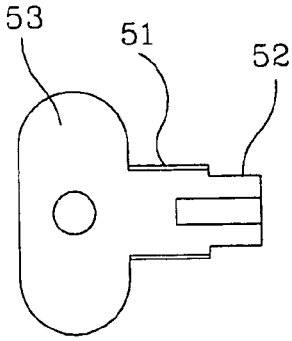
FIG. 4 is a longitudinal section view of a second embodiment of a reloading tool for reloading the apparatus in FIG. 1, after the operation of the release mechanism.
Figure 5:
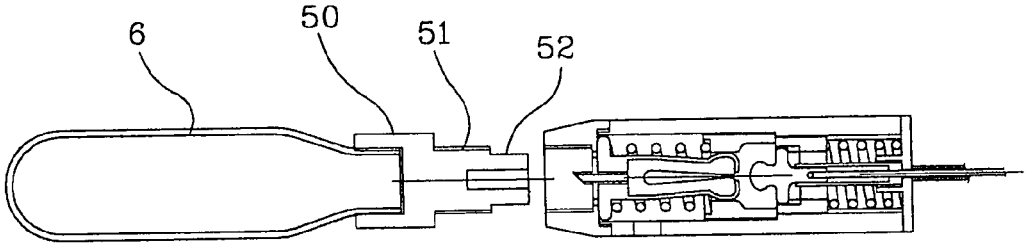
FIGS. 5 and 6 are diagrammatic longitudinal section views showing the piercing apparatus before and after its release mechanism being reloaded, respectively.
Figure 6:
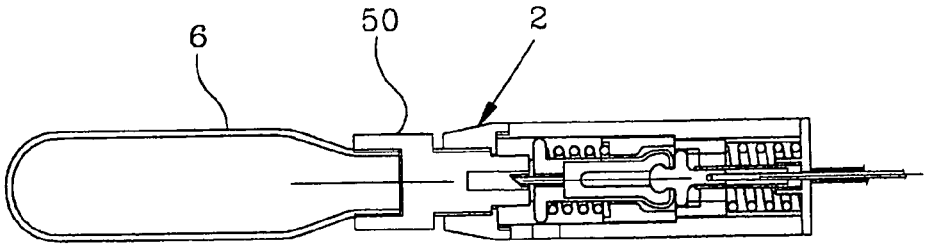

With reference to FIGS. 3 to 6, which are diagrammatic section views, there is shown a tool for reloading the piercing apparatus according to the invention. In a first embodiment thereof, shown in FIG. 3, the reloading tool has an elongated cylindrical body, including a maximum diameter, first section 50, an intermediate diameter, second section 51, and a minimum diameter, third section 52. The maximum diameter, first section 50 is internally hollow and is provided with an internal thread for screwing onto the threaded neck of the gas bottle 6. The second section 51, that is externally threaded, has a diameter equal to that of the neck of the gas bottle 6 with same thread. Finally, the minimum diameter, internally hollow, third section 52 is such that it surrounds the piercing element 7. By screwing the tool in FIG. 3 as shown in FIGS. 5 and 6, onto a bottle and then onto the mouth of the elongated housing 20, at the same way of a new bottle, the section 52 of the tool causes the collet chock 70 to move backward until the fingers 88 of the collet chock 70 engage the protuberance 87 of the release element. This engagement is made temporarily firm by the cam profile 90, against which the fingers 88 are retained, until the operation of the control means 3.

With reference to FIG. 4, a second embodiment of the tool for reloading the piercing apparatus according to the invention is shown. This second embodiment is characterized by a shaped body 53 comprising an externally threaded section 51 being equal to that one of the neck of the small bottle and a hollow end portion 52 such that it surrounds the piercing element 7 and cause it to move backward until the fingers of the collet chock 70 engage the protuberance 87 of the release element, as described with reference to the first embodiment of tool. In this second embodiment, the shaped body 53 acts as a handle.

At this moment, the reloading tool can be screwed and instead of it a new charged small bottle 6 can be located.

It is clear that the operation for restoring the expandable sack 1 inside a bag and reloading the piercing device by a new small bottle can be easily performed by any owner of the same bag, thanks to the characteristics of the piercing apparatus of the invention and to the reloading tools.

Figure 9:
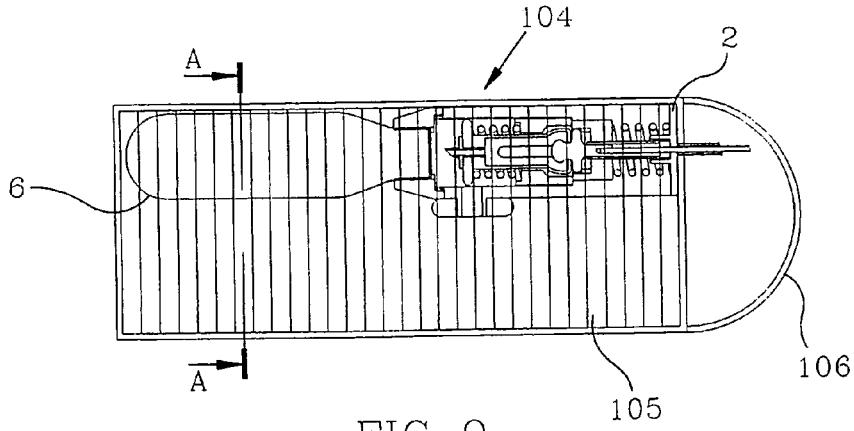
FIG. 9 is a diagrammatic top view showing in a phantom view the piercing apparatus according to the invention in a wait condition, the piercing apparatus being applied to a rescue device.
Figure 10:
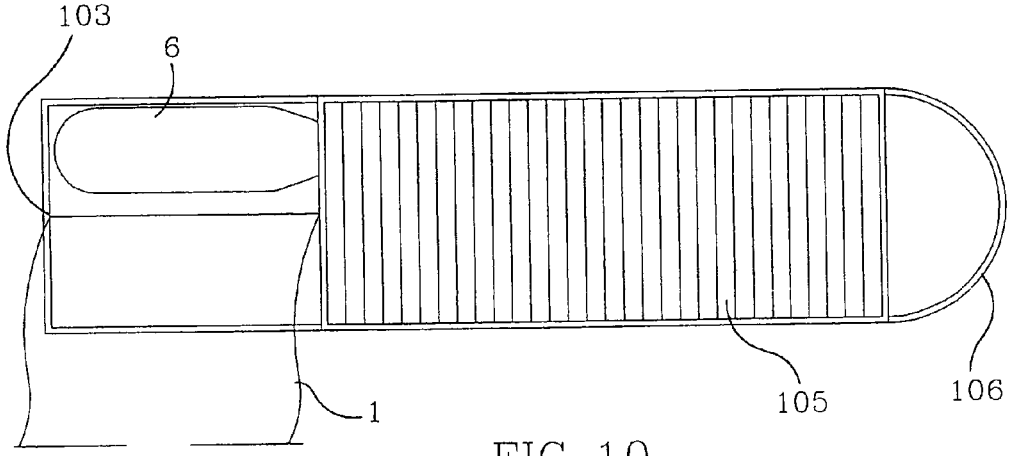
FIG. 10 is a diagrammatic fragmentary top view showing the rescue device in FIG. 9 in a operated state, the sack thereof being fully ejected.
Figure 11:
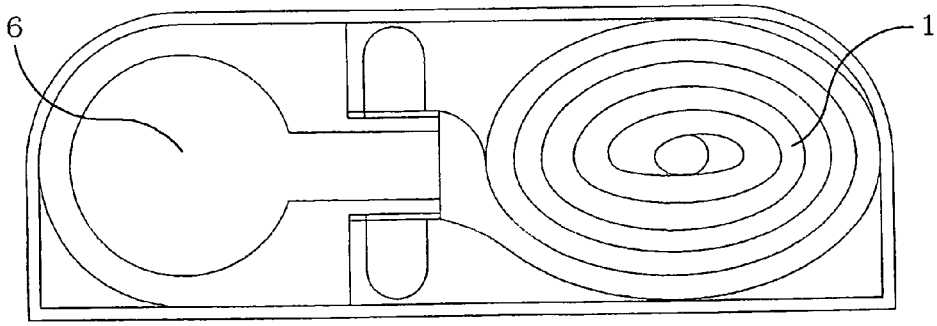
FIG. 11 is a diagrammatic cross-section view taken along line A—A in FIG. 9.

However, the piercing apparatus of the invention can have other employment. For example, with reference to FIGS. 9 to 11, a sea rescue device is diagrammatically shown. In a container 104 a compressed gas feeder 2 is located side to side to a rolled up expandable sack 1, as shown in FIG. 11. The container 104 has a slidable cover 105 with a handle 106. A free end of control means is connected to the slidable cover 104. Thereby, when the cover 104 is pulled for uncovering the sack 1, the sack 1 is inflated in virtue of the piercing of the small bottle 6.

What is claimed is:

1. A piercing apparatus for piercing a small compressed gas bottle to quickly inflate a sack, comprising:

an expandable sack (1) being arranged on a base (102; 103) of a container (100; 104);

a compressed gas feeder (2) located below the expandable sack (1), including:

a small compressed gas bottle (6) having a pierceable mouth (60) and an externally threaded neck (61), a housing (20) being connected to the small compressed gas bottle (6) and to the expandable sack (1), and in an inner chamber (21) of the housing a piercing element (7) having a bit (72) provided with an axial passageway (73) communicating with said expandable sack (1), a release mechanism (8), being charged by a counteracting spring (89) to push the piercing element (7) against the small compressed gas bottle (6), comprising a release element being connected to a flexible transmission (30) of control means (3);

characterized in that:

said release element is a protuberance (87) and is slidably mounted in said inner chamber (21) of the elongated housing (20) by the operation of the flexible transmission (30) against the counteracting spring (89); and said piercing element (7) is fixed on a front end of a collet chock (70), which, as such, is provided, in its rear end, with fingers (88) to grip said protuberance (87) of the release element; said collet chock (70) being slidable between a gripping condition and a releasing condition of said protuberance (87) upon the operation of control means.

2. The piercing device according to claim 1, characterized in that said collet chuck (70) is slidable coaxially with respect to an external cam profile (90) surrounding at least said fingers (88) under the action of a spiral spring (91) being abutted between a flange (92) of said front end of the collet chuck (70) and said external cam profile (90); the external cam profile (90), which is in abutment against an internal circumferential projection (93) of said inner chamber (21) of the elongated housing (20), having an internal space adapted to receive and retain said fingers (88) of the collet chuck (70) in engagement with the protuberance (87) against the slide of the same collet chuck (70).

3. The piercing device according to claim 1, characterized in that a portion of the elongated housing (20) near the connection with said gas bottle (6) is screwed to the remaining portion of the elongated housing (20).

4. The piercing device according to claim 1, characterized in that a seal gasket is situated around the connection with said flexible transmission (30) of said release element.

5. A tool for reloading the piercing apparatus according to claim 1, characterized in that this reloading tool has an elongated cylindrical body, including a maximum diameter, first section (50), which is internally hollow and is provided with an internal thread for screwing onto the threaded neck of a gas bottle (6), a second section (51), that is externally threaded, having a diameter equal to that of the neck of the gas bottle (6), and a minimum diameter, third section (52), being internally hollow such that it surrounds the piercing element (7) and causes the collet chock (70) to move backward until the fingers (88) of the collet chock (70) engage the protuberance (87) of the release element.

6. A tool for reloading the piercing apparatus according to claim 1, characterized in that said tool has a shaped body (53) comprising an externally threaded section (51) being equal to that one of the neck of the small bottle and a hollow end portion (52) such that it surrounds the piercing element (7) and causes it to move backward until the fingers of the collet chock (70) engage the protuberance (87).

* * * * *